US007500901B2

(12) United States Patent
Swedek et al.

(10) Patent No.: US 7,500,901 B2
(45) Date of Patent: Mar. 10, 2009

(54) DATA PROCESSING FOR MONITORING CHEMICAL MECHANICAL POLISHING

(75) Inventors: Boguslaw A. Swedek, Cupertino, CA (US); Nils Johansson, Los Gatos, CA (US); Manoocher Birang, Los Gatos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1 day.

(21) Appl. No.: 11/222,561

(22) Filed: Sep. 8, 2005

(65) Prior Publication Data

US 2006/0009131 A1 Jan. 12, 2006

Related U.S. Application Data

(63) Continuation of application No. 10/464,673, filed on Jun. 18, 2003, now Pat. No. 7,008,296.

(51) Int. Cl.
*B24B 49/00* (2006.01)
*B24B 51/00* (2006.01)

(52) U.S. Cl. ..... 451/5; 451/6; 451/8; 451/41; 700/121; 700/175

(58) Field of Classification Search ..... 451/5, 451/6, 8, 41, 285–289; 700/121, 175
See application file for complete search history.

(56) References Cited

U.S. PATENT DOCUMENTS 5,433,651 A 7/1995 Lustig et al.
5,559,428 A 9/1996 Li et al.
5,644,221 A 7/1997 Li et al.
5,660,672 A 8/1997 Li et al.
6,004,187 A 12/1999 Nyui et al.
6,072,313 A 6/2000 Li et al.
6,159,073 A 12/2000 Wiswesser et al.
6,172,756 B1 1/2001 Geels et al.
6,179,709 B1 1/2001 Redeker et al.
6,190,234 B1 2/2001 Swedek et al.
6,280,289 B1 8/2001 Wiswesser et al.
6,296,548 B1 10/2001 Wiswesser et al.
6,407,546 B1 6/2002 Le et al.
6,433,541 B1 8/2002 Lehman et al.
6,505,090 B1 * 1/2003 Harakawa ..... 700/121
6,524,165 B1 2/2003 Wiswesser et al.
6,558,229 B2 5/2003 Kimura et al.
6,707,540 B1 3/2004 Lehman et al.
6,790,123 B2 9/2004 Korovin et al.
6,811,466 B1 * 11/2004 Swedek et al. ..... 451/5

(Continued)

FOREIGN PATENT DOCUMENTS

EP 1063056 A2 12/2000

*Primary Examiner*—Maurina Rachuba
(74) *Attorney, Agent, or Firm*—Fish & Richardson

(57) ABSTRACT

Methods and apparatus to implement techniques for monitoring polishing a substrate. Two or more data points are acquired, where each data point has a value affected by features inside a sensing region of a sensor and corresponds to a relative position of the substrate and the sensor as the sensing region traverses through the substrate. A set of reference points is used to modify the acquired data points. The modification compensates for distortions in the acquired data points caused by the sensing region traversing through the substrate. Based on the modified data points, a local property of the substrate is evaluated to monitor polishing.

14 Claims, 6 Drawing Sheets

U.S. PATENT DOCUMENTS

| | | | | |
|---|---|---|---|---|
| 7,008,296 | B2 * | 3/2006 | Swedek et al. | 451/6 |
| 7,016,795 | B2 * | 3/2006 | Swedek et al. | 702/64 |
| 2001/0008827 | A1 | 7/2001 | Kimura et al. | |
| 2002/0002029 | A1 | 1/2002 | Kimura et al. | |
| 2002/0013007 | A1 | 1/2002 | Hasegawa et al. | |
| 2002/0013124 | A1 | 1/2002 | Tsujimura et al. | |
| 2002/0055192 | A1 | 5/2002 | Redeker et al. | |
| 2002/0077031 | A1 | 6/2002 | Johansson et al. | |
| 2002/0098777 | A1 | 7/2002 | Laursen et al. | |
| 2002/0155789 | A1 | 10/2002 | Bibby et al. | |
| 2002/0177916 | A1 * | 11/2002 | Poolla et al. | 700/108 |
| 2003/0053042 | A1 | 3/2003 | Chen | |
| 2003/0087459 | A1 | 5/2003 | Laursen et al. | |

* cited by examiner

DATA PROCESSING FOR MONITORING CHEMICAL MECHANICAL POLISHING

CROSS-REFERENCE TO RELATED APPLICATIONS

Under 35 U.S.C. §120, this application is a continuation application of and claims priority to U.S. application Ser. No. 10/464,673, filed on Jun. 18, 2003, now U.S. Pat. No. 7,008,296.

BACKGROUND

The present invention relates to monitoring during chemical mechanical polishing.

An integrated circuit is typically formed on a substrate by the sequential deposition of conductive, semiconductive or insulating layers on a silicon wafer. One fabrication step involves depositing a filler layer over a non-planar surface, and planarizing the filler layer until the non-planar surface is exposed. For example, a conductive filler layer can be deposited on a patterned insulating layer to fill the trenches or holes in the insulating layer. The filler layer is then polished until the raised pattern of the insulating layer is exposed. After planarization, the portions of the conductive layer remaining between the raised pattern of the insulating layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing slurry, including at least one chemically reactive agent, and abrasive particles if a standard pad is used, is supplied to the surface of the polishing pad.

An important step in CMP is detecting whether the polishing process is complete, i.e., whether a substrate layer has been planarized to a desired flatness or thickness, or when a desired amount of material has been removed. Overpolishing (removing too much) of a conductive layer or film leads to increased circuit resistance. On the other hand, underpolishing (removing too little) of a conductive layer leads to electrical shorting. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, the polishing endpoint cannot be determined merely as a function of polishing time.

To detect the polishing endpoint, the substrate can be removed from the polishing surface and transferred to a metrology station. At the metrology station, the thickness of a substrate layer can be measured, e.g., with a profilometer or a resistivity measurement. If the polishing endpoint is not reached, the substrate can be reloaded into the CMP apparatus for further processing.

Alternatively, polishing can be monitored in situ, i.e., without removing the substrate from the polishing pad. In-situ monitoring has been implemented with optical and capacitance sensors. For in-situ endpoint detection, other techniques propose monitoring friction, motor current, slurry chemistry, acoustics, or conductivity. A recently developed endpoint detection technique uses eddy currents. The technique involves inducing an eddy current in the metal layer covering the substrate, and measuring the change in the eddy current as the metal layer is removed by polishing.

SUMMARY

To efficiently evaluate thickness of a substrate, reference traces are used to process data traces acquired by a monitor during polishing. In general, in one aspect, the invention provides methods and apparatus to implement techniques for monitoring polishing a substrate. Two or more data points are acquired, where each data point has a value affected by features inside a sensing region of a sensor and corresponds to a relative position of the substrate and the sensor as the sensing region traverses through the substrate. A set of reference points is used to modify the acquired data points. The modification compensates for distortions in the acquired data points caused by the sensing region traversing through the substrate. Based on the modified data points, a local property of the substrate is evaluated to monitor polishing.

Particular implementations can include one or more of the following features. Acquiring data points can include acquiring one or more data points that are affected by eddy currents in the substrate. Modifying the acquired data points can include using one or more reference points to compensate for local sensitivity changes of the sensor as the sensing region traverses through the substrate. Compensating for local sensitivity changes can include dividing the value of one or more acquired data points by a corresponding sensitivity value that is based on the one or more reference points to compensate for local sensitivity changes of the sensor.

Modifying the acquired data points can include using one or more reference points to compensate for local bias changes in the acquired data points as the sensing region traverses through the substrate. Compensating for local bias changes can include subtracting one or more reference values from the value of corresponding acquired data points, the one or more reference values being based on the one or more reference points to compensate for local bias changes.

Modifying the acquired data points can include compensating for signal loss caused by an edge of the substrate traversing through the sensing region. Compensating for signal loss caused by an edge can include calculating one or more reference points characterizing overlaps of the sensing region and the substrate.

The set of reference points can be acquired with the sensor. Acquiring the set of reference points can include measuring a specially prepared substrate with the sensor and/or measuring the substrate with the sensor before polishing.

Evaluating a local property of the substrate can include evaluating a thickness of a metal layer on the substrate. Based on the evaluation of the thickness, an endpoint can be detected for polishing the metal layer on the substrate, and/or one or more parameters of the polishing process can be modified.

The invention can be implemented to provide one or more of the following advantages. Multiple data traces can be acquired and processed during a single polishing operation without interrupting the polishing. By using reference traces, the acquired data traces can be processed, e.g., by locally adjusting bias and/or normalization, to more accurately and efficiently evaluate substrate thickness that is remaining or has been removed during polishing. The data traces can be analyzed to determine a polishing profile describing thickness variations of the polished metal layer. Based on the polishing profile, the polishing process can be modified to obtain an optimally polished substrate. The thickness of the metal layer can be efficiently evaluated even near the edge of the substrate. The data traces can be analyzed for improved endpoint detection. The acquired data traces can be processed to minimize effects of an incomplete overlap between a substrate and a sensing region of a monitor, or to adjust local biases. Reference traces can be acquired by the same monitor that is used to acquire the data traces.

In another aspect, the invention is directed to a method for monitoring polishing of a substrate. In the method, a reference trace is generated. The reference trace represents a scan of a sensor of an in-situ monitoring system across a face of a substrate prior to a polishing step. The substrate is polished in a chemical mechanical polishing system, and during polishing a measurement trace is generated by scanning the sensor of the in-situ monitoring system across the face of the substrate. The measurement trace is modified using the reference trace, and a polishing endpoint is detected from the modified measurement trace.

Implementations of the invention may include one or more of the following features. Modifying the measurement trace may include subtracting the reference trace from the measurement trace or dividing the measurement trace by the reference trace. Generating the reference trace may include scanning the sensor of the in-situ monitoring system across the face of the substrate prior to the polishing step, or calculating an overlap between a sensing region of the sensor and the substrate. The sensor of the in-situ monitoring system may make a plurality of sweeps across the face of the substrate to generate a plurality of measurement traces, and each of the plurality of measurement traces may be modified using the reference trace.

In another aspect, the invention is directed to a polishing apparatus. The apparatus has a carrier to hold a substrate, a polishing surface, a motor, a monitoring system and a controller. The motor is connected to at least one of the carrier and the polishing surface to generate relative motion between the substrate and the polishing surface. The monitoring system includes a sensor that scans across a face of the substrate while the substrate is contacting the polishing surface and generates a measurement trace. The controller is configured to modify the measurement trace using a reference trace representing a scan of the sensor of the in-situ monitoring system across the face of the substrate prior to polishing, and configured to detecting a polishing endpoint from the modified measurement trace.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
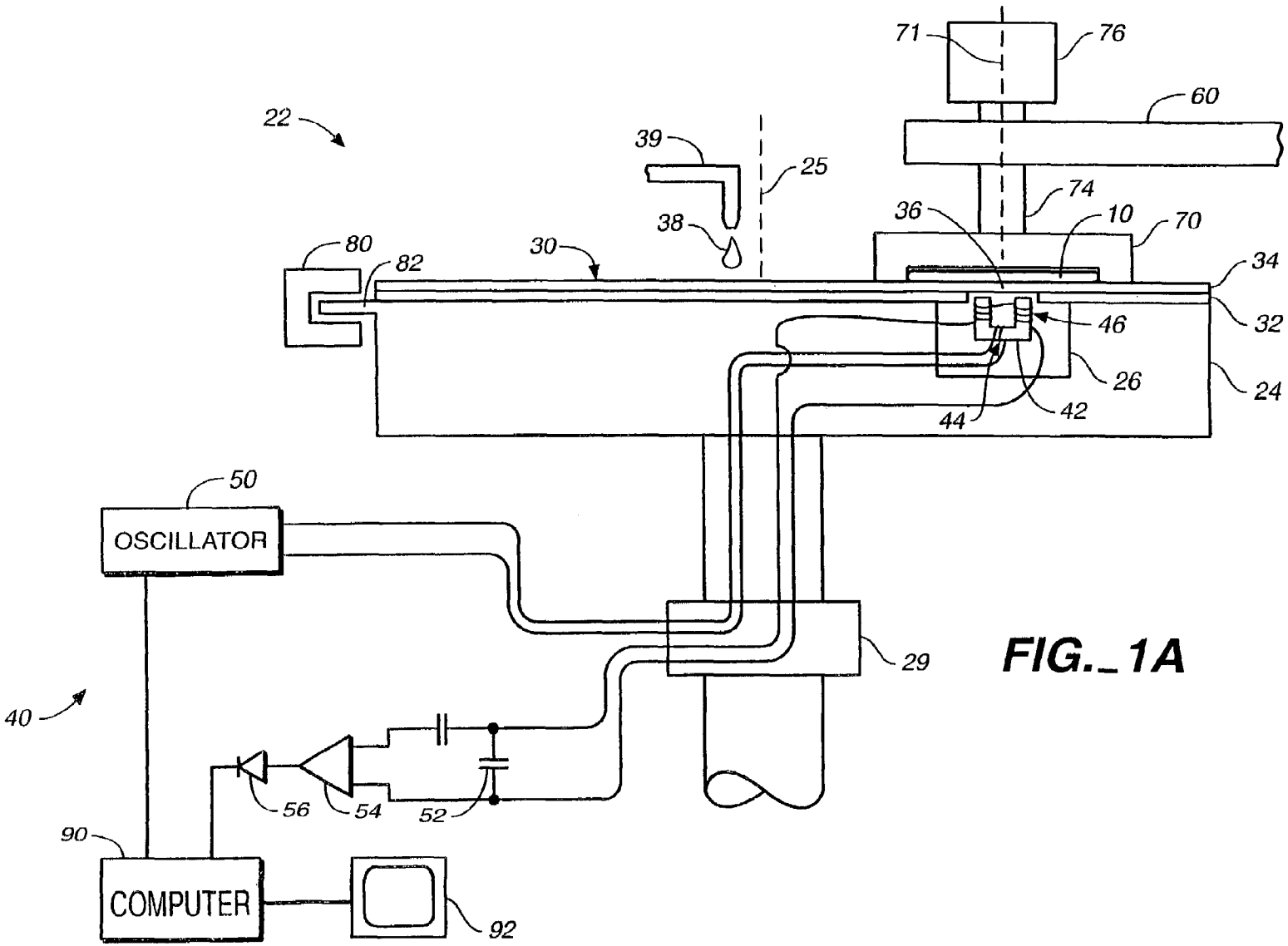
FIGS. 1A and 1B are schematic diagrams showing a substrate polished in a CMP apparatus and monitored by an in-situ monitor using eddy currents.
Figure 1B:
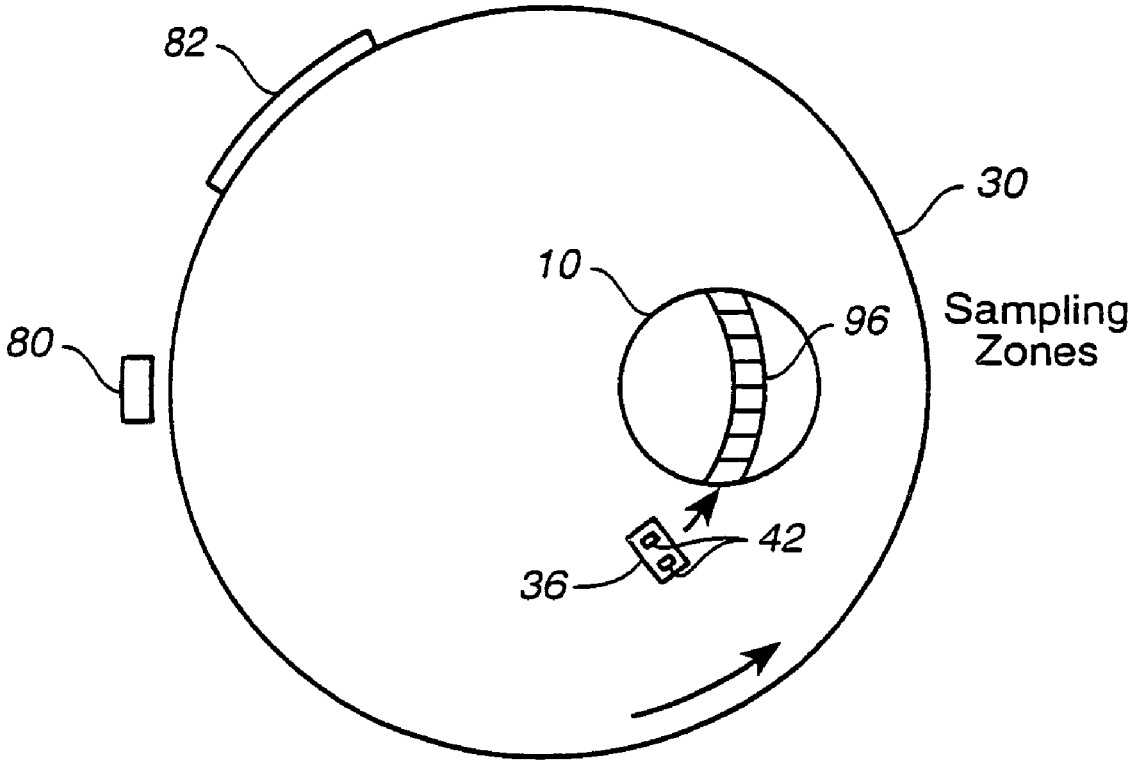

FIGS. 1A and 1B show a substrate 10 polished in a polishing apparatus and monitored by an in-situ monitor 40. The in-situ monitor 40 can acquire data traces characterizing thickness of the substrate during polishing, as discussed with reference to FIGS. 2A and 2B. The acquired data traces can be processed to increase spatial resolution of measured thickness by using reference traces, and the processed traces can be used for endpoint detection, as discussed with reference to FIGS. 3-6B.

As shown in FIG. 1A, the substrate 10 can be polished or planarized at a polishing station 22 of a polishing apparatus. For example, the polishing apparatus can be a CMP apparatus, such as described in U.S. Pat. No. 5,738,574, the entire disclosure of which is incorporated herein by reference. The substrate 10 can include a silicon wafer having a dielectric layer, e.g., an oxide, covered by a conductive layer, e.g., a metal such as copper. The dielectric layer has a surface with patterned trenches and holes that are filled by the conductive layer. By polishing the conductive layer until the underlying surface of the insulating layer is exposed, the portion of the conductive layer remaining in the trenches and holes can form circuit elements for an integrated circuit.

The substrate 10 is held at the polishing station 22 by a carrier head 70. A description of a suitable carrier head 70 can be found in U.S. Pat. No. 6,218,306, the entire disclosure of which is incorporated herein by reference. The carrier head 70 presses the substrate 10 against a polishing pad 30 that rests on a platen 24. During polishing, a platen 24 supporting the polishing pad 30 rotates about a central axis 25, and a motor 76 rotates the carrier head 70 about an axis 71. The polishing pad 30 typically has two layers, including a backing layer 32 that abuts a surface of the platen 24 and a covering layer 34 that is used to polish the substrate 10. A polishing slurry 38 can be supplied to the surface of the polishing pad 30 by a slurry supply port or combined slurry/rinse arm 39.

The polishing station 22 uses the in-situ monitor 40 for endpoint detection. The in-situ monitor 40 monitors thickness of a metal layer on the substrate 10. A suitable in-situ monitor is disclosed in U.S. Pat. Nos. 6,924,641, and 6,966,816, the entire disclosures of which are incorporated herein by reference.

In one implementation, the in-situ monitor 40 includes a drive coil 44 and a sense coil 46 wound around a core 42 that is positioned in a recess 26 of the platen 24. By driving the coil 44 with an oscillator 50, the in-situ monitor 40 generates an oscillating magnetic field that extends through the polishing pad 30 into the substrate 10. In the metal layer of the substrate, the oscillating magnetic field induces eddy currents that are detected by the sense coil 46. The sense coil 46 and a capacitor 52 form an LC circuit. The impedance in the LC circuit is influenced by the eddy currents in the metal layer. As the thickness of the metal layer changes, the eddy currents and the impedance change as well. To detect such changes, the capacitor 52 is coupled to an RF amplifier 54 that sends a signal to a computer 90 through a diode 56.

A general purpose programmable digital computer 90 can be connected to amplifier 56 to receive the intensity signal from the eddy current sensing system. The computer 90 can evaluate the signal to detect an endpoint, or to measure a thickness of the metal layer. Computer 90 can be programmed to sample amplitude measurements from the monitoring system when the substrate generally overlies the core, to store the amplitude measurements, and to apply the endpoint detection logic to the measured signals to detect the polishing endpoint. Possible endpoint criteria for the detector logic include local minima or maxima, changes in slope, threshold values in amplitude or slope, or combinations thereof. Optionally, user interface devices, such as a display 92, can be connected to the computer 90. the display can provide information to an operator of the polishing apparatus.

In operation, the core 42, drive coil 44, and sense coil 46 rotate with the platen 24. Other elements of the in-situ monitor 40 can be located apart from the platen 24, and coupled to the platen 24 through a rotary electrical union 29.

FIG. 1B shows the motion of the core 42 relative to the substrate 10 during polishing. The core 42 is located below a section 36 of the polishing pad 30 on the platen 24. As the platen 24 rotates, the core 42 sweeps beneath the substrate 10. A position sensor 80 can be added to the polishing station 22 (see also FIG. 1A) to sense when the core 42 is beneath the substrate 10. The position sensor 80 can be an optical interrupter mounted on the carrier head 70. Alternatively, the polishing apparatus can include an encoder to determine the angular position of the platen 24.

As the core 42 passes beneath the substrate 10, the in-situ monitor 40 generates data points based on the signal from the sense coil 46 around the coil 42 at a substantially constant sampling rate. A suitable sampling rate can be chosen by considering the rotation rate of the platen 24 and the desired spatial resolution for measured data. For example, at typical rotation rates of about 60-100 rpm (i.e., revolution per minute), a 1 KHz sampling rate (i.e., generating one datapoint per millisecond) provides a spatial resolution of about one millimeter. Larger sampling rates or smaller rotation rates may increase the spatial resolution.

The in-situ monitor 40 detects eddy currents in a sensing region around the core 42. As the platen 24 rotates and the core 42 moves relative to the substrate 10, each data point corresponds to a sampling zone 96 through which the sensing region sweeps during the sampling time for the data point. In one implementation, the duration of the sampling time is set by the inverse of the sampling rate. The size of the sampling zone 96 depends on the rotation rate of the platen 24, the sampling rate, and the size of the sensing region. The size of the sensing region also puts a limit on the spatial resolution of the measured data.

The in-situ monitor 40 generates data points corresponding to sampling zones 96 with different radial positions on the substrate 10. By sorting the data points according to the radial positions of the corresponding sampling zones, the in-situ monitor 40 can monitor the thickness of the metal layer as a function of the radial position on the substrate 10. For example, if the core 42 is positioned so that it passes beneath the center of the substrate 10, the in-situ monitor 40 will scan sampling zones with radial positions starting at the substrate's radius, moving through the center of the substrate, and back to the substrate's radius, as the core 42 sweeps beneath the substrate.

Figure 2A:
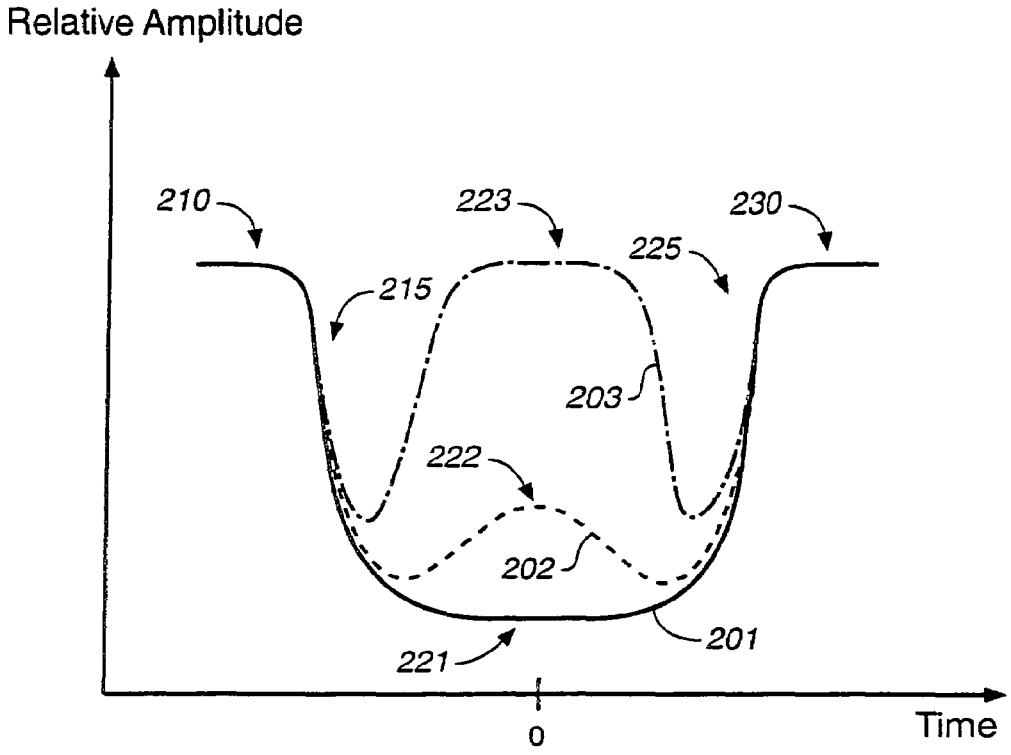
FIGS. 2A and 2B show schematic traces of data points acquired by an in-situ monitor using eddy currents.
Figure 2B:
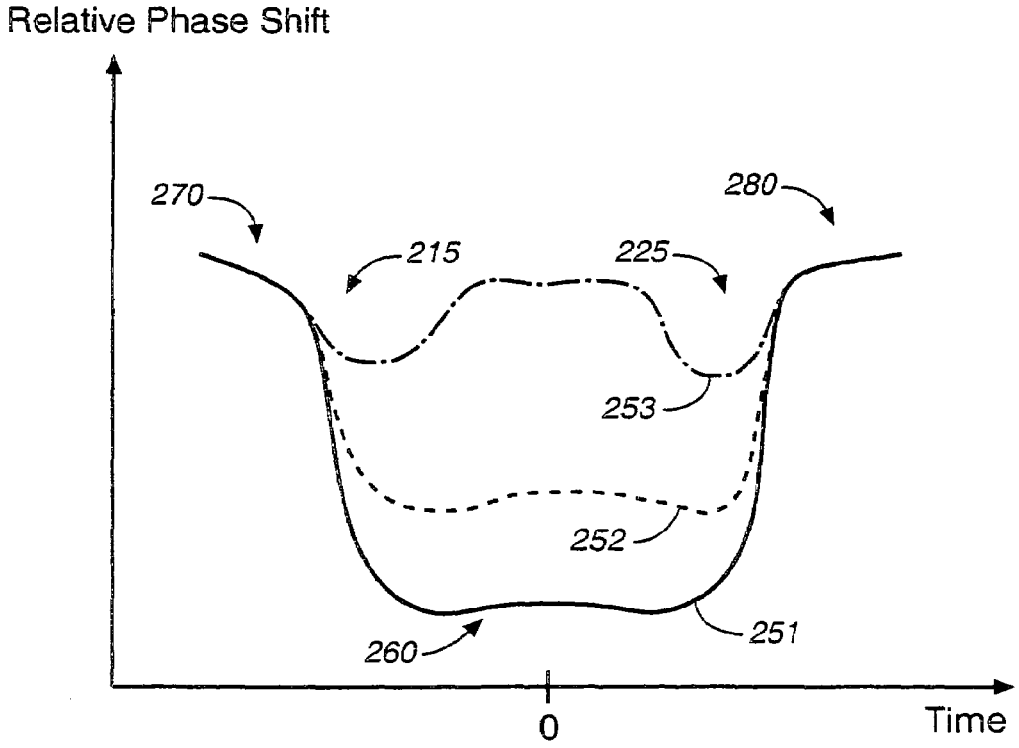

FIGS. 2A and 2B show schematic traces formed by data points acquired by the in-situ monitor 40 scanning the substrate 10 as the platen 24 rotates. Each data point (the individual data points are not illustrated in these traces, only the resulting overall traces) is indexed by a time indicating when the data point is measured during the sweep of the core 42 beneath the substrate. Because the platen 24 rotates, the time indices correspond to sampling zones with different radial positions. Zero time index corresponds to a sampling zone including the center of the substrate 10, and increasing absolute time indices correspond to sampling zones with increasing radial position.

FIG. 2A shows three schematic traces acquired by measuring a relative amplitude of the signal received from the RF amplifier 54 (see FIG. 1A). The first trace is a reference amplitude trace 201 acquired by scanning the substrate 10 before starting a polishing operation. The second 202 and third 203 traces are amplitude traces acquired during polishing, near the middle and the end, respectively, of the polishing operation.

The reference amplitude trace 201 has flat portions where data points have substantially the same value for a range of time indices. At large absolute time indices, a first 210 and a third 230 flat portions include data points measured when the entire substrate is outside of the sensing region of the core 42. Accordingly, the first 210 and third 230 flat portions have the same relative amplitude value. Near zero time index, a second flat portion 221 includes data points that are measured when the substrate is in the entire sensing region. Due to the presence of a metal layer on the substrate, the second flat portion 221 has smaller relative amplitude than the first 210 and third 230 flat portions.

Between the first 210 and second 221 flat portions in the reference amplitude trace 201, there is a first edge region 215 including data points that are measured when the substrate's leading edge is inside the sensing region of the core 42. As the substrate moves into the sensing region with increasing time indices, the relative amplitude of the data points decreases from the value of the first flat portion 210 to the value of the second flat portion 221. Similarly in a second edge region 225, data points between the second 221 and third 230 flat portions are measured when the substrate's trailing edge is inside the sensing region. As the substrate moves out of the sensing region with increasing time indices, the relative amplitude of the data points increases from the amplitude value of the second flat portion 221 to the amplitude value of the third flat portion 230.

The second amplitude trace 202 is acquired by scanning the substrate 10 during polishing of the metal layer on the substrate, near the middle of the polishing operation. The second amplitude trace 202 has the same first 210 and third 230 flat portions as the reference amplitude trace 201, because data points in these flat portions are measured when the substrate is outside of the sensing region. When the substrate is at least in part in the sensing region, the data points have an increased relative amplitude value in the second amplitude trace 202 compared to the corresponding values in the reference amplitude trace 201. The amplitude-value is increased due to the decreasing thickness of the metal layer on the substrate.

Around zero time index, instead of the second flat portion 221 in the reference amplitude trace 201, the second amplitude trace 202 shows a "hump" 222 of increased relative amplitudes. The "hump" 222 is a result of uneven polishing that has produced a thinner metal layer near the center of substrate than near the edges.

The third amplitude trace 203 is acquired by scanning the substrate 10 near the end of the polishing of the metal layer on the substrate. The third amplitude trace 203 has the same first 210 and third 230 flat portions as the reference amplitude trace 201. Near zero time index, i.e., near the center of the substrate, however, the third amplitude trace 203 has a fourth flat portion 223 that has a different amplitude value than the second flat portion 221 in the reference amplitude trace 201.

The fourth flat portion 223 has a relative amplitude value that is close to the amplitude value of the first 210 and third 230 flat portions where the substrate is outside of the sensing region. In one implementation, only the polished metal layer can support eddy currents in the sensing region, and such relative amplitude value of the portion 223 can indicate that the second polishing has almost entirely removed the metal layer near the center of the substrate. In alternative implementations, the amplitude value of the portion 223 can be different from the amplitude value of the first 210 and third 230 flat portions even if the metal layer has been removed. For example, the substrate or the head can include additional metal layers or other conductive elements that can support eddy currents in the sensing region and alter the amplitude value of the portion 223.

FIG. 2B shows three schematic traces 251-253 formed by data points acquired by measuring a relative phase shift between signals received from the RF amplifier 54 and the oscillator 50 (see FIG. 1A). The three phase traces 251-253 in FIG. 2B correspond to the same scans of the substrate as the three amplitude traces 201-203 shown in FIG. 2A.

The phase traces 251-253 have similar qualitative features than the amplitude traces 201-203. For example, similar to the second flat portion 221 in the reference amplitude trace 201, the first, i.e., reference, phase trace 251, has a flat portion 260 near zero time index. Furthermore, in the second 252 and third 253 phase traces, the relative phase shift values increase compared to the corresponding values in the reference phase trace 251 qualitatively the same way as in the case of the amplitude traces. For example, similar to the "hump" 222, the second and third phase traces have increased relative phase shift values near the center of the substrate due to the uneven polishing. Furthermore, in outer regions 270 and 280, similar to the first 210 and third 230 flat portions of the amplitude traces, the relative phase shift data points do not sensibly change after the substrate is polished, i.e., in the second 252 and third 253 phase traces.

Figure 3:
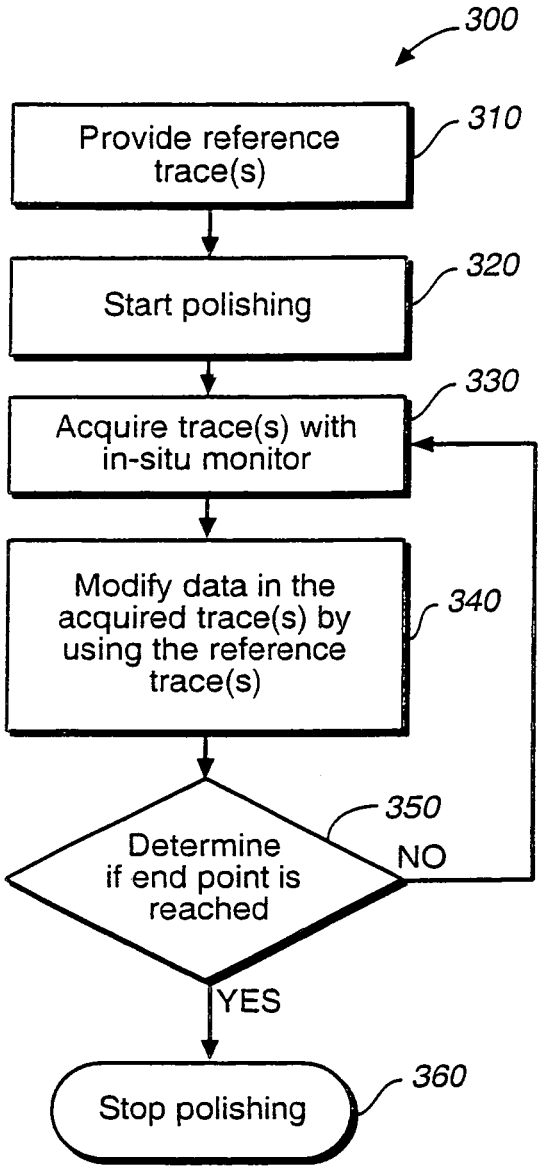
FIG. 3 is a flowchart showing a method for detecting polishing endpoint with an in-situ monitor in one implementation of the invention.

FIG. 3 is a flowchart showing a method 300 for detecting polishing endpoint with an in-situ monitor, such as the in-situ monitor 40 measuring eddy currents (FIGS. 1A and 1B). To efficiently determine if a polishing endpoint is reached, the method 300 uses reference data to modify data traces acquired by the in-situ monitor.

The method 300 starts by providing one or more reference traces (step 310). In one implementation, a reference trace is acquired by scanning the substrate with the in-situ monitor before starting polishing the substrate. FIGS. 2A and 2B show acquired reference traces 201 and 251 for amplitude and phase traces, respectively. The acquired reference traces can be used to measure a thickness that is removed during polishing the substrate.

Alternatively or in addition, a reference trace can be acquired by scanning a "perfect" reference substrate that has a metal layer with one or more high precision features, such as an especially flat surface, a high rotational symmetry around the center, or known thickness values for one or more radial zones. The "perfect" reference trace can be used to measure the remaining thickness of the substrate during polishing.

Optionally, a reference trace can be obtained from theoretical considerations alone or in combination with an acquired trace. For example, a theoretical functional form can be specified for the reference trace, and parameters in the functional form can be adjusted to fit the acquired trace.

After starting to polish the substrate (step 320), data points are acquired with the in-situ monitor (step 330) to form an acquired trace. The acquired trace has data point values that are related to the thickness of the substrate, such as the relative amplitude and phase shift values shown in FIGS. 2A and 2B, respectively. Data points in the acquired trace are modified by using the reference trace (step 340), to facilitate detecting an endpoint from the data points. Modifying the acquired trace is discussed in more detail with reference to FIGS. 4-6B.

As processing proceeds, the modified data from one or more of the previous traces is analyzed to determine if the polishing has reached an endpoint (decision 350). Endpoint detection can be based on one or more criteria. For example, remaining or removed thickness can be evaluated at preselected radial positions or can be averaged over regions of the substrate. Alternatively, an endpoint can be detected without evaluating thickness, for example, by comparing the modified data to a threshold value of relative amplitude or phase shift.

If polishing has not reached the endpoint ("No" branch of decision 350), a new data trace is acquired (i.e., the method 300 returns to step 330). Thus, for each sweep of the sensor beneath the substrate, a separate new trace can be generated without stopping the operation or removing the substrate, and each new trace can be modified using the same reference trace to generate the modified data.

Optionally, the acquired trace can be analyzed to determine how to modify the polishing process in order to obtain an optimally polished substrate. For example, if necessary, the carrier head can be adjusted to apply different pressure on the substrate. When it is determined that the endpoint is reached ("Yes" branch of decision 350), the polishing stops (step 360).

Figure 4:
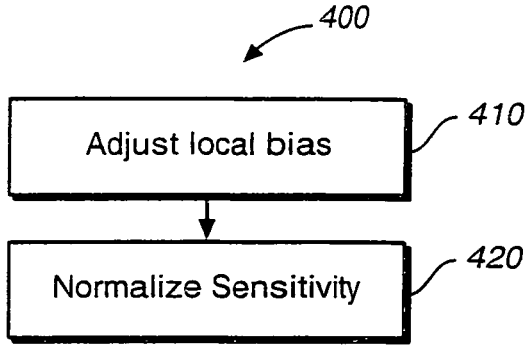
FIG. 4 is a flowchart showing a method for data processing to detect polishing endpoint in one implementation of the invention.

As shown in FIG. 4, a method 400 can use a reference trace to modify data in an acquired trace to facilitate evaluation of substrate thickness from the data points. The modified data traces can be used to determine an endpoint as discussed with reference to FIG. 3.

Bias is locally adjusted (step 410) in the acquired trace based on a comparison with the reference trace. Different local bias at different positions in the acquired trace can be caused by, e.g., the presence or absence of metal parts at different locations in the substrate or the polishing head, or a partial overlap between the sensing region of the monitor and the substrate.

In one implementation, bias is adjusted using a reference trace that has data points with the same time indices as the acquired trace. For each time index, the adjusted data point value can be obtained by subtracting the data point value in the reference trace from the data point value in the acquired trace. Alternatively, if the acquired trace has data points with time indices that are not available in the reference trace, data points with the required time indices can be generated from the reference trace, for example, by using a standard interpolation or extrapolation formula. Exemplary local bias adjustments are discussed below with reference to FIGS. 5A and 5B.

After bias adjustment, sensitivity is normalized in the acquired trace (step 420), e.g., using a sensitivity function. For each time index (or radial position) in the acquired trace, the sensitivity function specifies a sensitivity value that characterizes the sensitivity of the sensor to detect changes in the thickness of the metal layer of the substrate. The sensitivity value can be different at different radial positions, for example, because the substrate covers different percentages of the sensing region of the sensor, or due to the presence or absence of metal parts in the substrate or the polishing head.

In one implementation, the sensitivity function can be generated from an acquired reference trace such as the reference amplitude trace 201 shown in FIG. 2A. For example, a global bias can be applied to the reference amplitude trace 201 such that the first 210 and third 230 flat portions take zero data value, because these portions correspond to zero sensitivity. After applying the global bias, the reference amplitude trace can be globally multiplied by a number such that the relative amplitude value of the second flat portion 221 becomes one, corresponding to full sensitivity. The resulting sensitivity function will have values between zero and one in the first 215 and second 225 edge regions. Optionally, the sensitivity function can be filtered to remove measurement noise originally present in the reference trace.

Alternatively, the sensitivity function can be estimated from the overlap between the substrate and a sensing region around the in-situ monitor that has acquired the data trace. For example, as the overlap decreases, the same difference in the metal layer thickness causes decreasing difference in the measured signal. That is, a partial overlap limits the sensitivity of the in-situ monitor to detect features of the metal layer on the substrate. In one implementation, the sensitivity function is obtained by normalizing the overlaps to be one near the center of the substrate. The size of the sensing region can be estimated, for example, from a size of the magnetic core that the in-situ monitor uses to induce and detect eddy currents in a metal layer of the substrate. Optionally, the sensitivity function can include dependence on a distance between the substrate and the in-situ monitor.

In one implementation, sensitivity is normalized by dividing data point values in the acquired trace with the corresponding sensitivity value of the sensitivity function. The normalization can be restricted to regions of the acquired trace where the sensitivity value of the sensitivity function is substantially different from zero. In regions where the sensitivity function is essentially zero, the normalized trace can have an assigned zero value. Examples for normalizing sensitivity are discussed below with reference to FIGS. 6A and 6B.

Optionally, the two steps of the method 400 can be performed in reversed order, or one of the steps can be omitted. Alternatively, the two steps can be combined into a single deconvolution step using, e.g., Fourier data analysis.

The data processing method 400 can be used to compensate for edge effects in the acquired trace. Edge effects occur as the edge of the substrate moves through a sensing region of the in-situ monitor. Examples of edge effects include the first 215 and second 225 edge regions shown in FIGS. 2A and 2B. In the edge regions, data point values depend not only on the properties of the substrate but also on the degree of overlap between the substrate and the sensing region. For example, due to a partial overlap, data point values can pick up an extra amplitude or phase value that changes as the in-situ monitor sweeps under the substrate. The extra amplitude or phase values can be compensated by the local bias adjustment (step 410). Furthermore, as explained above, when the degree of overlap changes, the in-situ monitor has a changing sensitivity to detect features of the substrate. The changing sensitivity can be compensated by the sensitivity normalization (step 420).

Figure 5A:
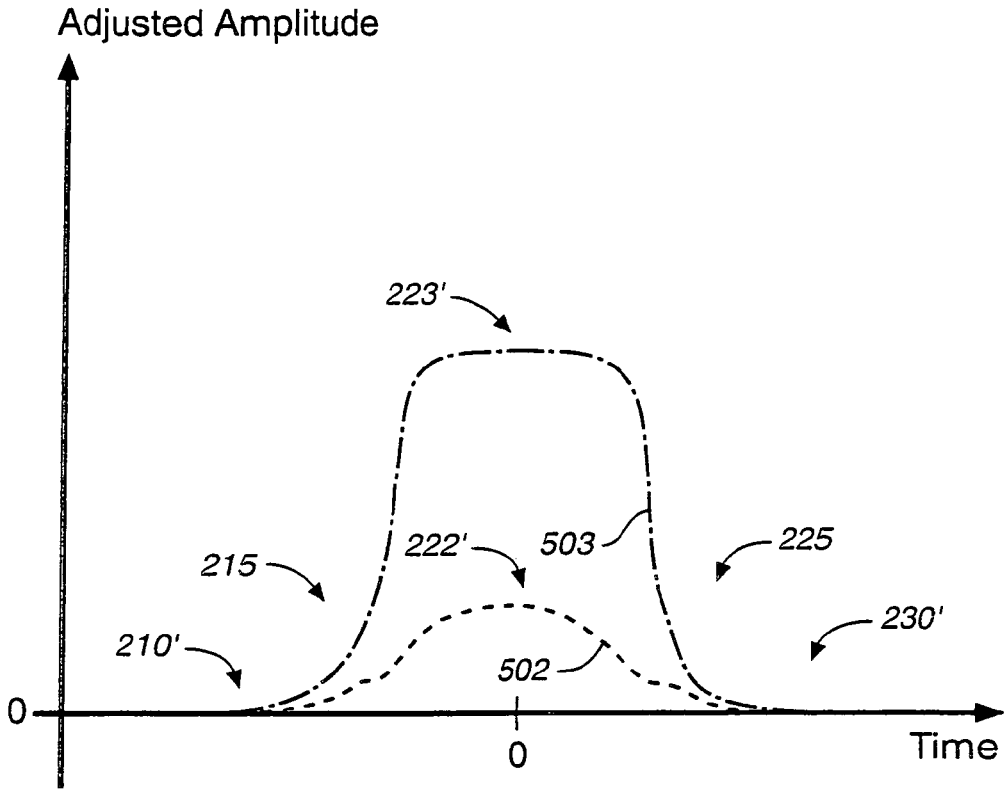
FIGS. 5A and 5B show schematic traces of data points generated from the acquired data points in FIGS. 2A and 2B, respectively, by locally adjusting bias.
Figure 5B:
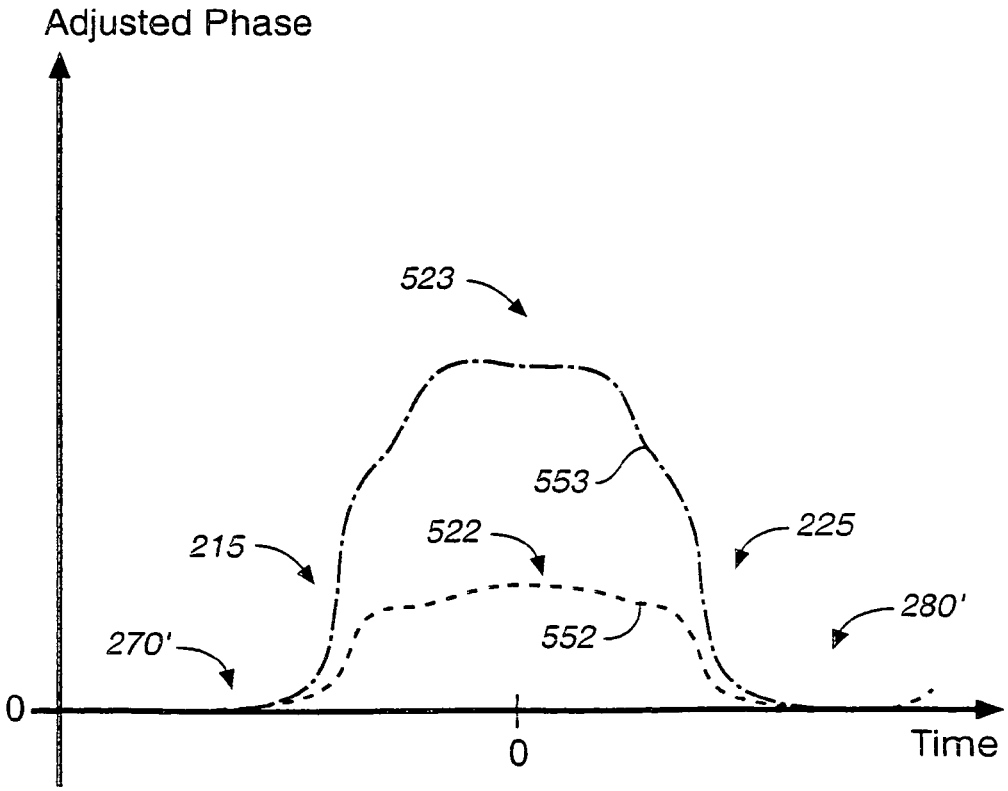

FIGS. 5A and 5B show schematic examples of adjusted traces generated by locally adjusting bias in data traces acquired by an in-situ monitor, such as the in-situ monitor 40 (FIGS. 1A and 1B). The adjusted traces can be generated, for example, by using the techniques discussed with reference to FIG. 4.

FIG. 5A shows adjusted amplitude traces 502 and 503 generated from the second 202 and third 203 amplitude traces in FIG. 2A, respectively. The adjusted amplitude traces 502 and 503 have been generated by subtracting the reference amplitude trace 201 from the second 202 and third 203 amplitude traces, respectively: for each time index, the reference data point value has been subtracted from data point values that have the same time index in the amplitude traces.

The adjusted amplitude traces 502 and 503 may indicate how much of the metal layer has been removed during the polishing. For example, the local bias adjustment moves the first 210 and third 230 flat portions in the amplitude traces into first 210' and third 230' adjusted flat portions, respectively, where each adjusted flat portion is characterized by zero adjusted amplitude value. The zero adjusted amplitude value indicates that polishing has not affected these portions where the polished substrate is out of the sensing region of the in-situ monitor. Furthermore, near zero time index, i.e., in adjusted portions 222' and 223', the larger the adjusted amplitude value the larger the thickness that has been removed from the metal layer during polishing.

Starting from the first 210' and third 230' adjusted flat portions, the adjusted amplitude traces 502 and 503 increase in the edge regions 215 and 225 towards the center of the substrate represented by zero time index. In the edge regions 215 and 225, the adjusted amplitude values depend not only on the thickness of the removed metal layer, but also on the percentage of the sensing region covered by the metal layer.

FIG. 5B shows adjusted phase traces 552 and 553 generated from the second 252 and third 253 phase traces in FIG. 2B, respectively. The adjusted phase traces 552 and 553 have been generated by subtracting the reference phase trace 251 from the second 252 and third 253 phase traces, respectively: for each time index, the reference data point value has been subtracted from the data point values that have the same time index in the phase traces.

Similar to the adjusted amplitude traces, the adjusted phase traces 552 and 553 have adjusted phase values that indicate how much of the metal layer has been removed during polishing. For example, the adjusted flat portions 270' and 280' have zero adjusted phase values indicating no effect of polishing, and in the portions 522 and 523 near zero time index, the adjusted phase values indicate the thickness of the removed metal layer. In the edge regions 215 and 225, the adjusted phase values also depend on the percentage that the metal layer covers in the sensing region of the in-situ monitor.

Figure 6A:
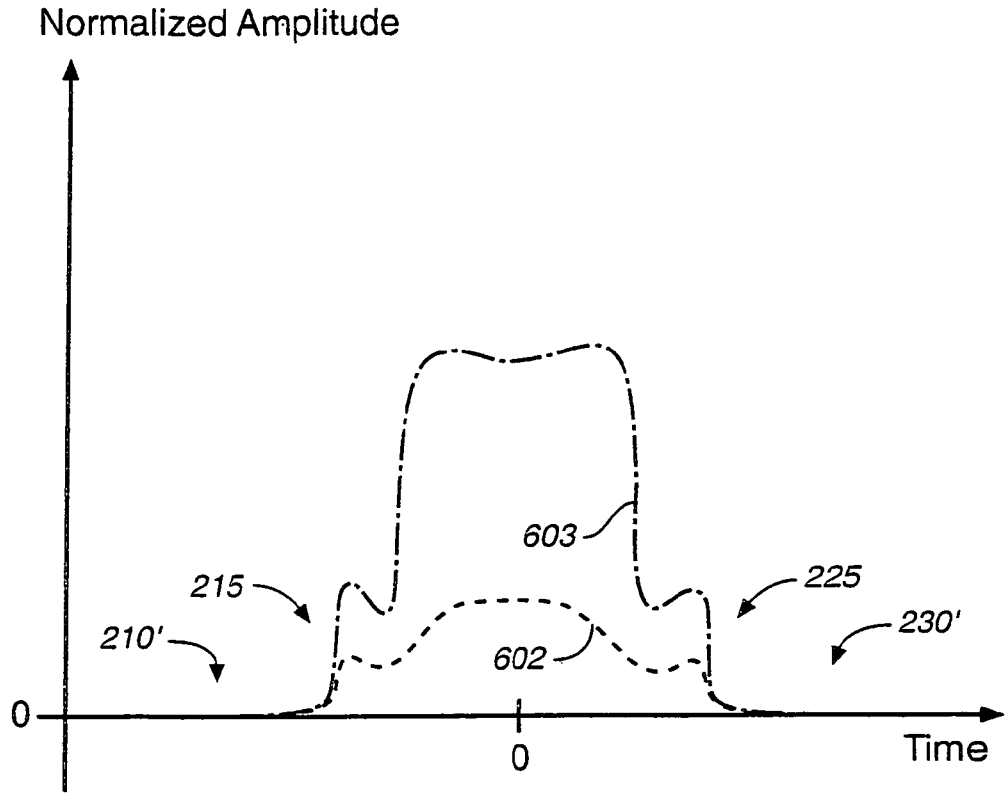
FIGS. 6A and 6B show schematic traces of data points generated from the acquired data points in FIGS. 2A and 2B, respectively, by normalizing sensitivity.
Figure 6B:
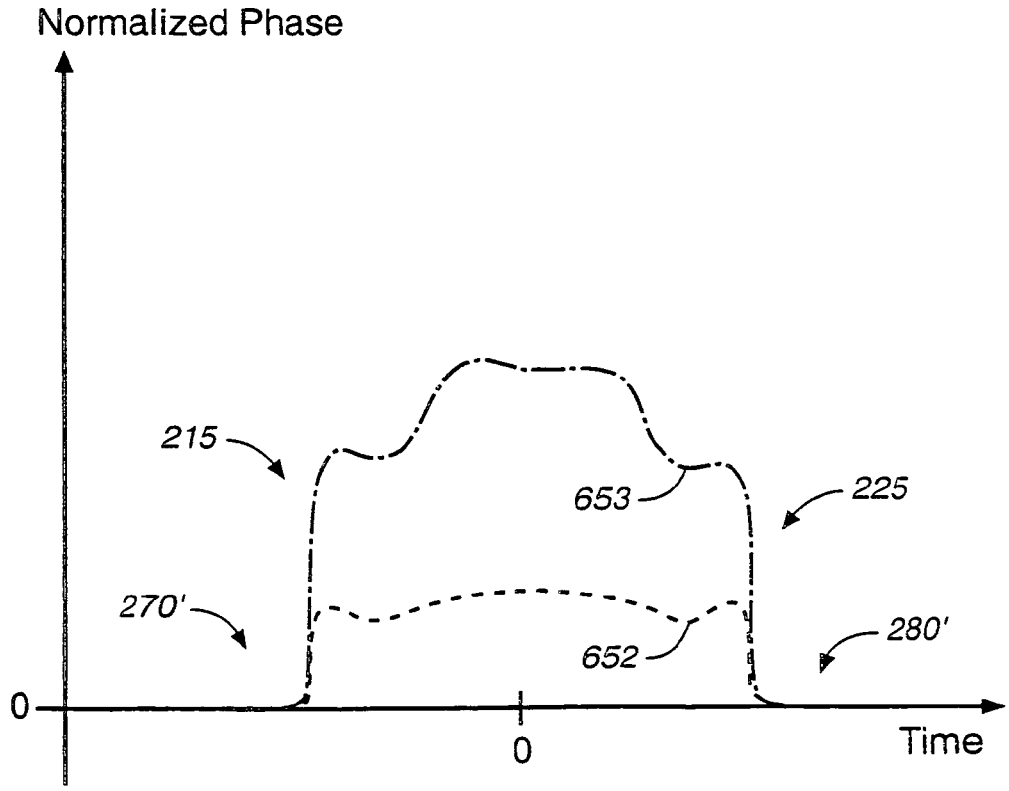

FIGS. 6A and 6B show schematic normalized amplitude and phase traces, respectively, by normalizing sensitivity. FIG. 6A shows normalized amplitude traces 602 and 603, generated from the adjusted amplitude traces 502 and 503 (FIG. 5A), respectively. FIG. 6B shows normalized phase traces 652 and 653 generated from the adjusted phase traces 552 and 553 (FIG. 5B), respectively. All sensitivity normalization has used an estimated sensitivity function: for each time index of the data traces, a sensitivity function value has been estimated from the overlap of the substrate and a sensing region of the in-situ monitor. Except for data points in the zero value flat portions 210', 230', 270', and 280', sensitivity has been normalized by dividing data points by corresponding sensitivity function values, i.e., the sensitivity values with the same time index.

Due to the sensitivity normalization, data point values are changing sharply with time indices in the first 215 and second 225 edge regions (see FIGS. 6A and 6B). The sharp change reflects that the edge of the substrate moved into the sensing region of the sensor. By using the sensitivity normalization, the thickness of the metal layer can be efficiently evaluated near the edge of the substrate.

A number of embodiments of the invention have been described. Nevertheless, it will be understood that various modifications may be made without departing from the spirit and scope of the invention. For example, the invention may be applicable to other sorts of in-situ monitoring systems, such as optical monitoring systems or monitoring based on measuring acoustic emission, friction coefficient, or temperature. In addition, the invention may be applicable to polishing system configurations other than rotary platens. Accordingly, other embodiments are within the scope of the following claims.

What is claimed is:

1. A computer program product, tangibly stored on machine-readable medium, for monitoring polishing of a substrate, the product comprising instructions operable to cause a processor to:

acquire measurement data from scanning of a sensor across a substrate, the measurement data including two or more measurements, each measurement corresponding to a zone on the substrate and having a value affected by a property of a substrate in the respective zone;

modify the acquired measurement data using reference data to compensate for distortions in the acquired measurement data caused by the sensor scanning across the substrate; and evaluate the property of the substrate based on the modified measurement data.

2. The computer program product of claim 1, wherein:

the instructions to acquire measurement data include instructions to acquire one or more measurements affected by eddy currents in the substrate.

3. The computer program product of claim 1, wherein:

the instructions to modify the acquired measurement data using reference data include instructions to use the reference data to compensate for local sensitivity changes of the sensor as the sensor scans across the substrate.

4. The computer program product of claim 3, wherein:

the instructions to use the reference data to compensate for local sensitivity changes include instructions to divide the value of one or more acquired measurements by a corresponding sensitivity value that is based on the reference data to compensate for local sensitivity changes of the sensor.

5. The computer program product of claim 1, wherein:

the instructions to modify the acquired measurement data using reference data include instructions to use the reference data to compensate for local bias changes in the acquired measurement data as the sensor scans across the substrate.

6. The computer program product of claim 5, wherein:

the instructions to use the reference data to compensate for local bias changes include instructions to subtract one or more reference values from the value of corresponding acquired measurements, the one or more reference values being based on the reference data to compensate for local bias changes.

7. The computer program product of claim 1, wherein:

the instructions to modify the acquired measurement data using reference data include instructions to compensate for signal loss caused by the sensor scanning across an edge of the substrate.

8. The computer program product of claim 7, wherein:

the instructions to compensate for signal loss caused by the sensor scanning across an edge of the substrate include instructions to calculate one or more reference points characterizing overlaps of the sensor and the substrate.

9. The computer program product of claim 1, further comprising instructions to:

acquire the reference data with the sensor.

10. The computer program product of claim 9, wherein:

the instructions to acquire the reference data include instructions to measure a specially prepared substrate with the sensor.

11. The computer program product of claim 9, wherein:

the instructions to acquire the reference data include instructions to measure the substrate with the sensor before polishing.

12. The computer program product of claim 1, wherein:

the instructions to evaluate the property of the substrate includes instructions to evaluate a thickness of a metal layer on the substrate.

13. The computer program product of claim 12, further comprising instructions to:

based on the evaluation of the thickness, detect an endpoint for polishing the metal layer on the substrate.

14. The computer program product of claim 12, further comprising instructions to:

based on the evaluation of the thickness, modify one or more parameters of the polishing process.

* * * * *